US007374363B2

(12) United States Patent
Bousson, Sr. et al.

(10) Patent No.: US 7,374,363 B2
(45) Date of Patent: May 20, 2008

(54) SAFE REMOVABLE BOLLARD

(75) Inventors: Mitchell A. Bousson, Sr., Castro Valley, CA (US); Robert L. Carpenter, Redwood City, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 11/520,845

(22) Filed: Sep. 12, 2006

(65) Prior Publication Data

US 2008/0063470 A1 Mar. 13, 2008

(51) Int. Cl.
*E01F 9/00* (2006.01)
*E01F 13/00* (2006.01)

(52) U.S. Cl. ..... 404/10; 404/6; 49/49

(58) Field of Classification Search ..... 404/6, 404/9, 10; 116/63 R; 49/49
See application file for complete search history.

(56) References Cited

U.S. PATENT DOCUMENTS 3,973,511 A 8/1976 Balston
4,215,643 A 8/1980 Jefferies et al.
5,018,902 A 5/1991 Miller et al.
5,365,694 A * 11/1994 Macaluso ..... 49/49
5,481,828 A * 1/1996 Kentrotas ..... 49/35
5,520,479 A * 5/1996 Hernandez ..... 404/6
5,895,169 A * 4/1999 Holm et al. ..... 404/9
6,409,419 B1 * 6/2002 Hernandez ..... 404/6
6,805,515 B2 * 10/2004 Reale ..... 404/11
7,077,598 B1 7/2006 Leonhardt et al.

* cited by examiner

*Primary Examiner*—Thomas B Will
*Assistant Examiner*—Alina Schiller
(74) *Attorney, Agent, or Firm*—Lumen Patent Firm, Inc.

(57) ABSTRACT

A removable bollard is provided. A bollard is attached to a bollard plate with a catch fixed to one end and a lock juncture fixed near the opposite end of the bollard plate. Additionally provided is a base plate with a catch receiver at one end of the base plate, a retractable latch and a latch receiver at an opposite end of the base plate. The retractable latch has a first position and a second position. In the first position the catch is encompassed by the catch receiver on the base plate to couple with the base plate end, where the retractable latch is then locked to the lock juncture to lock the bollard plate to the base plate. When in the second position, the retractable latch is recessed into the latch recess within the base plate and the bollard and bollard plate are removed, leaving an obstruction-free access way.

13 Claims, 7 Drawing Sheets

(a)

(b)

SAFE REMOVABLE BOLLARD

FIELD OF THE INVENTION

The invention relates generally to bollards. More particularly, the invention relates to removable bollards that provide an obstruction-free mounting platform compatible with the Americans with Disabilities Act (ADA) standards when the bollard post is removed.

BACKGROUND

Bollards are strong metal posts that can be used to close a road or path to vehicles above a certain width. Bollards can be mounted close enough to block ordinary cars, for instance, but wide enough to permit special-purpose vehicles, bicycles or pedestrians through. Bollards can be used to enclose car-free zones: removable bollards allow access for emergency vehicles.

Currently there exist several types of removable bollards. Typically, the current removable bollards have a fixed-plate embedded in concrete foundations that have a locking stem fixed to the plate that protrudes up from the plate when the bollard is removed. This protrusion creates potential tripping hazards for pedestrians, bicyclist or disabled individuals, where numerous injuries have occurred. Other removable bollards include a fixed-plate with a sizeable hole that, if left uncovered by oversight or by tampering, poses a serious potential hazard to the passerby.

Accordingly, there is a need for a safe removable bollard that does not leave a hole or an obstruction when the bollard is removed to overcome the current shortcomings in the art.

SUMMARY OF THE INVENTION

The present invention provides a removable bollard that has a bollard attached to a bollard plate with a catch fixed to a first end of the bollard plate and a lock juncture fixed near to a second end of the bollard plate. The invention further has a base plate with a catch receiver at a first end of the base plate, a retractable latch and a latch receiver at a second end of the base plate. The retractable latch has a first position and a second position, such that when in the first position the catch on the bollard plate is encompassed by the catch receiver to coupled with the base plate first end, and the retractable latch is locked to the lock juncture to lock the bollard plate to the base plate. When the retractable latch is in the second position, the retractable latch is recessed into the latch recess within the base plate and the bollard plate is removed from the base plate, leaving an obstruction-free access way.

In one aspect of the invention, the bollard plate is of generally planar rectangular shape where the second end has a latch through-slot of generally rectangular-U-shape with a latch through-slot open end positioned at about the center of the bollard plate second end.

In another aspect of the invention, the bollard is attached to the top surface of the bollard plate and positioned about perpendicular near the center of the bollard plate.

In another aspect of the invention, the catch is of generally extruded L-shape having a top end, a catch inner L-surface and a catch outer L-surface, where the catch inner L-surface is attached to the second end of the bollard plate with the catch top end aligned with the bollard plate top surface.

In another aspect of the invention, the lock juncture is of generally extruded L-shape having a lock juncture inner L-surface and a lock juncture outer L-surface, with a lock juncture through-hole positioned near the center of the lock juncture vertical wall and a lock juncture planar base is attached to the bollard plate top surface with a corner of the lock juncture outer L-surface positioned near the latch through-slot.

In another aspect of the invention, the base plate is of generally planar rectangular shape having a base plate top surface, a base plate bottom surface, a base plate first end, a base plate second end and a latch port through the base plate that is positioned near the base plate second end and centered along a longitudinal axis of the base plate. Further, the base plate has at least three anchor J-bolts attached perpendicularly to the base plate bottom surface for embedding in a pre-hardened foundation. In one aspect of the invention, the latch port is of generally rectangular shape.

In another aspect of the invention, the catch receiver is of generally extruded U-shape having a catch receiver first wall, a catch receiver second wall and a pair catch receiver end plates attached to the extruded ends. The catch receiver second wall is shorter that the catch receiver first wall by an amount about equal to the thickness of the base plate. The catch receiver second wall is attached perpendicular to the base plate bottom surface along the base plate first end with the catch receiver first wall positioned away from the base plate first end to form an opening sufficient for receiving the catch therein.

In another aspect of the invention, the retractable latch is of generally planar J-shape having a lock through-hole located near the base of the J-shape and a pivot through-hole located along the straight leg of the J-shape, where the retractable latch has a retractable latch front side and a retractable latch back side.

In another aspect of the invention, the latch recess has a latch plate, a pair of latch plate mounting brackets, a latch bearing and a latch housing. The latch plate is of generally planar rectangular shape having a latch plate top side, a latch plate bottom side and a latch plate through-slot that is positioned approximately along a latch plate central longitudinal axis, and has latch plate mounting holes through the latch plate that are positioned near each end of the latch plate through-slot and along the longitudinal axis. The latch plate mounting brackets are of generally extruded L-shape having a threaded mounting bracket hole through the base of the mounting bracket L-shape for receiving mounting screws inserted through the latch plate mounting holes. The mounting brackets are attached to the base plate bottom side across a first end and a second end of the latch port. The latch bearing has a pair of bearing plates and a latch limiting bracket, where the bearing plates are of generally rectangular shape having a central hole for receiving an axle there through, and are attached perpendicularly to the latch plate bottom side along each side of the longitudinal length of the latch plate through-slot, and with a first end of the bearing plate positioned near the latch plate center. The latch limiting bracket is of generally extruded L-shape and attached to the first end of each of the bearing plates to span said latch plate through-slot. The latch is positioned between the bearing plates and an axle is inserted through the mounting plates central hole and through the latch through hole and secured to enable the retractable latch to pivot through the latch plate through-slot and through the latch through-slot in the bollard plate second end, where the retractable latch first side abuts the latch limiting bracket to concentrically align the lock through-hole with the lock juncture through-hole for receiving a lock there through. The latch housing is of generally rectangular-box shape having a housing top end attached to the base plate bottom surface and positioned around the rectangular port in the base plate, where the latch housing shields the retractable latch and the latch bearing.

The advantages of the aspects of the present invention are when the bollard and bollard plate are removed from the base plate, there is no tripping hazards in the form of obstructions or holes exposed by the base plate. The retractable latch is aided by gravity to automatically recess into the latch recess when the bollard and bollard plate are removed.

BRIEF DESCRIPTION OF THE FIGURES

The objectives and advantages of the present invention will be understood by reading the following detailed description in conjunction with the drawing, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

Figure 1:
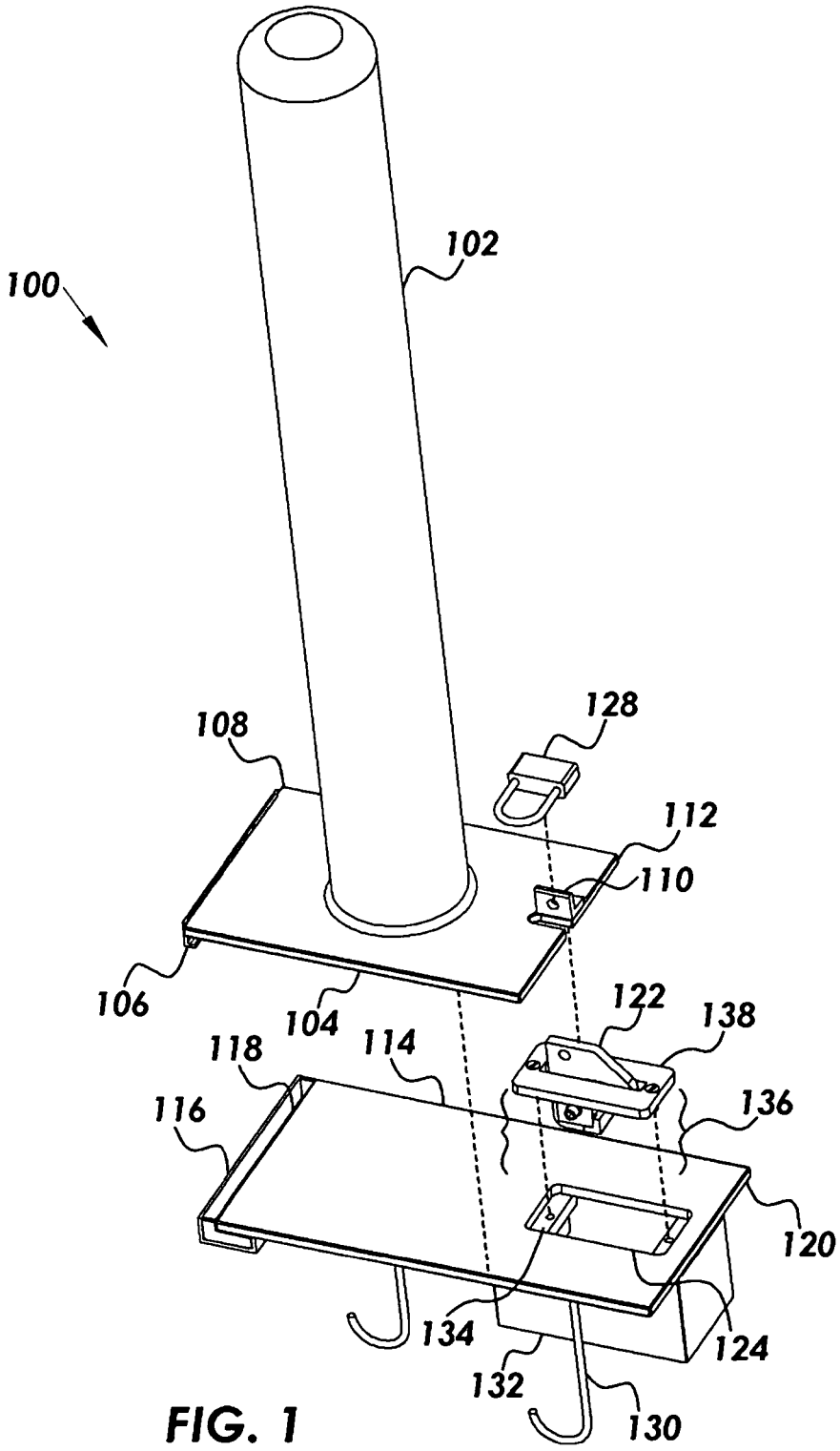
FIG. 1 shows an exploded perspective view of a removable bollard according to the present invention.
Figure 6:
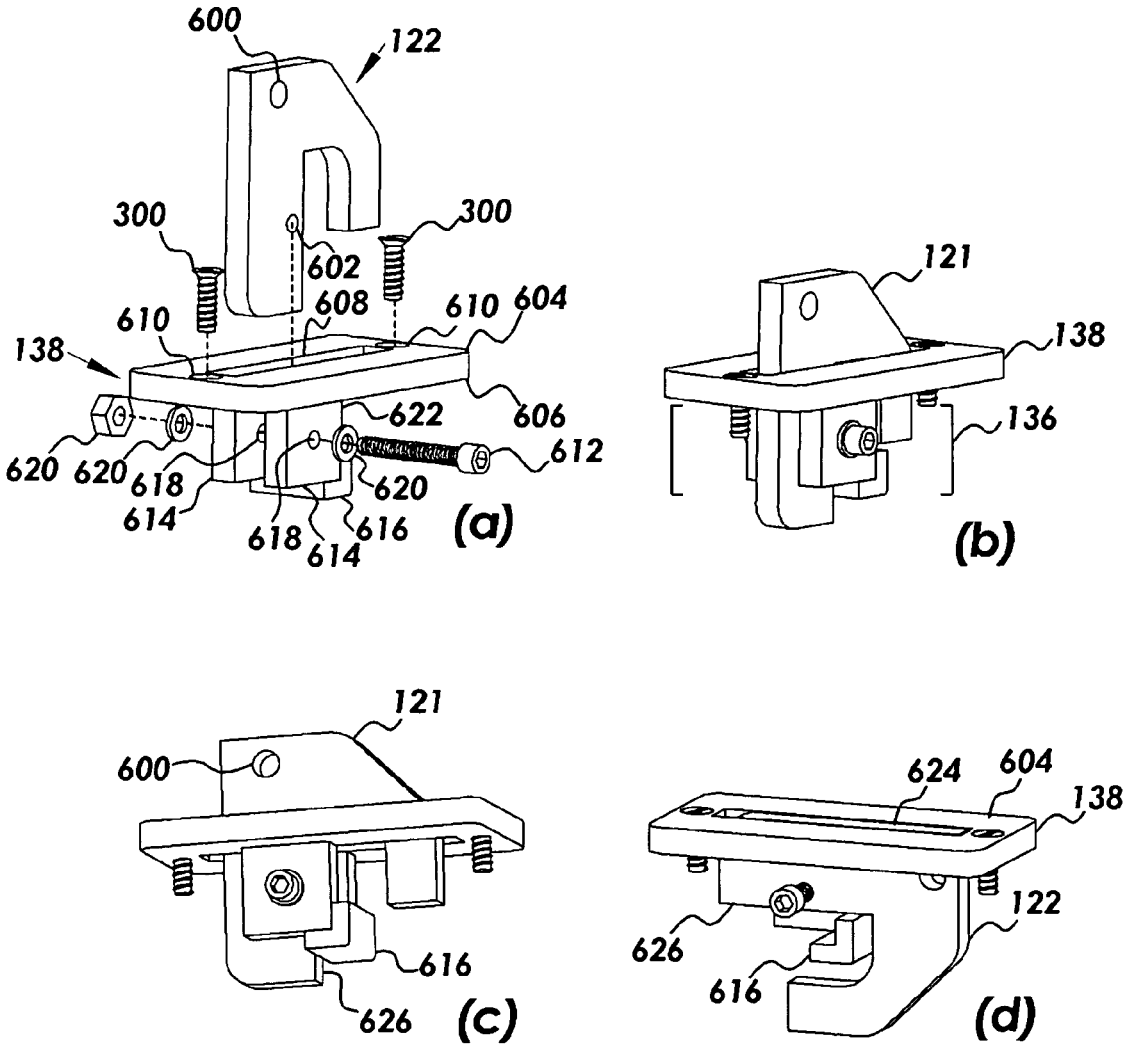
FIGS. 6*a-d* show perspective views of the retractable latch in an exploded view, and the retractable latch in the first position and in the second position, respectively according to the present invention.

Referring to the figures, FIG. 1 shows an exploded perspective view of a removable bollard 100 according to the present invention, depicting a bollard 102 attached to a bollard plate 104 with a catch 106 attached to the bollard plate first end 108 and a lock juncture 110 attached near the bollard plate second end 112. The invention further has a base plate 114 with a catch receiver 116 at the base plate first end 118, a retractable latch 122 and a latch plate port 124 at the base plate second end 120 for holding a latch recess made from a latch housing 132, pair of latch plate mounting brackets 134, and a latch bearing 136 (see FIG. 6). The catch 106 has a length, for example an extruded length, that is shorter than the length of the catch receiver 116 to allow the catch 106 to be inserted to and removed from the catch receiver 116. The retractable latch 122 has a first position and a second position, where it is depicted in the first position in FIG. 1 with the catch 106 on the bollard plate 104 fitted to be encompassed by the catch receiver 116 to couple with the base plate first end 118, and the retractable latch 122 is locked using a lock 128 to the lock juncture 110 to lock the bollard plate 104 to the base plate 114. Further depicted are J-bolts 130 attached to the base plate 114 for embedding into a pre-hardened foundation (not shown).

Figure 2:
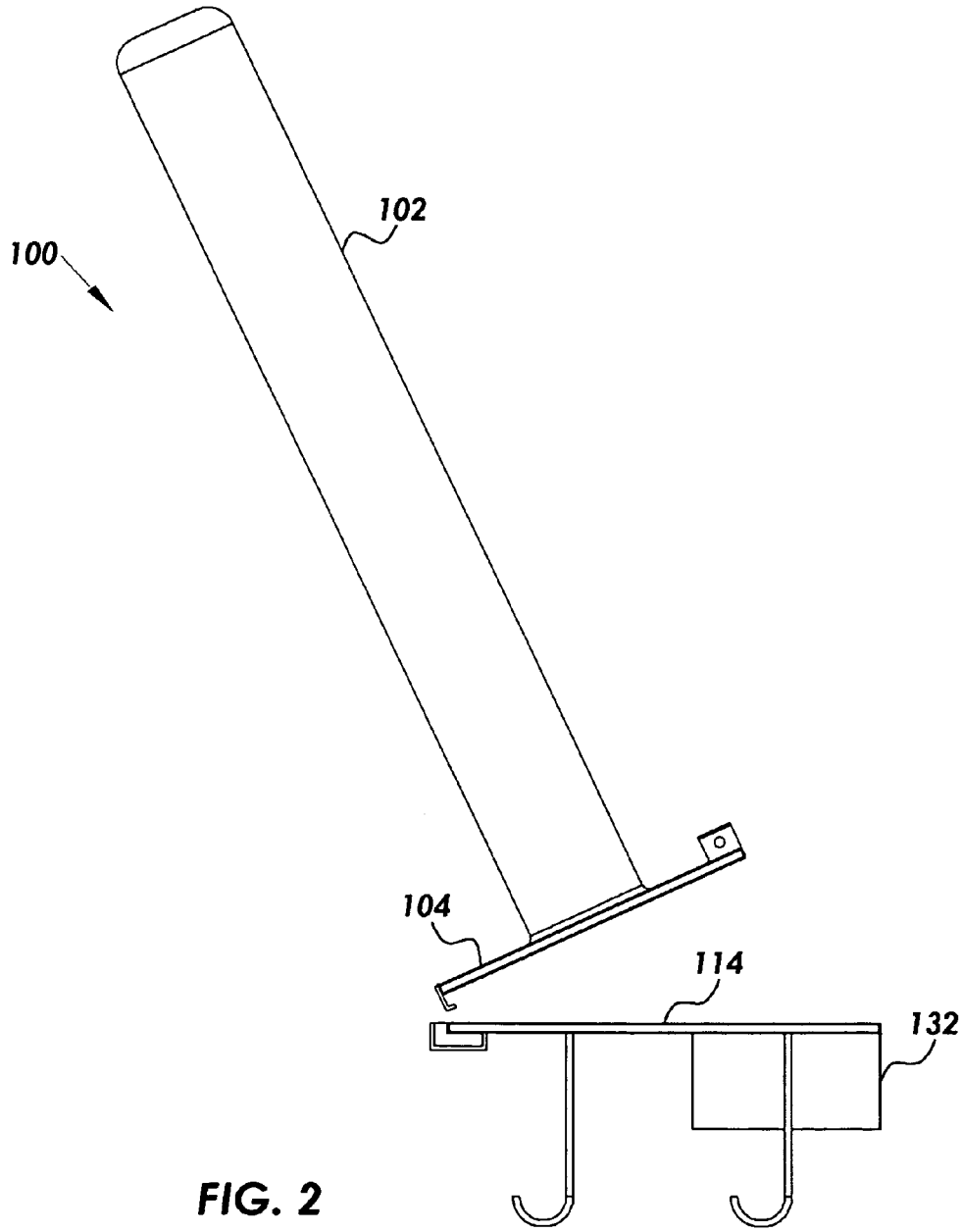
FIG. 2 shows a planar view of the bollard and bollard plate removed from the base plate according to the present invention.

FIG. 2 shows a planar view of the removable bollard 100 with the bollard 102 and bollard plate 104 removed from the base plate 114. When in the second position, the retractable latch 112 (not shown) is recessed into the latch recess within the base plate 114, where the latch housing 132 is the only element of the latch recess depicted in this drawing. Further depicted is the bollard plate 104 removed from the base plate 114, leaving an obstruction-free access way.

Figure 3:
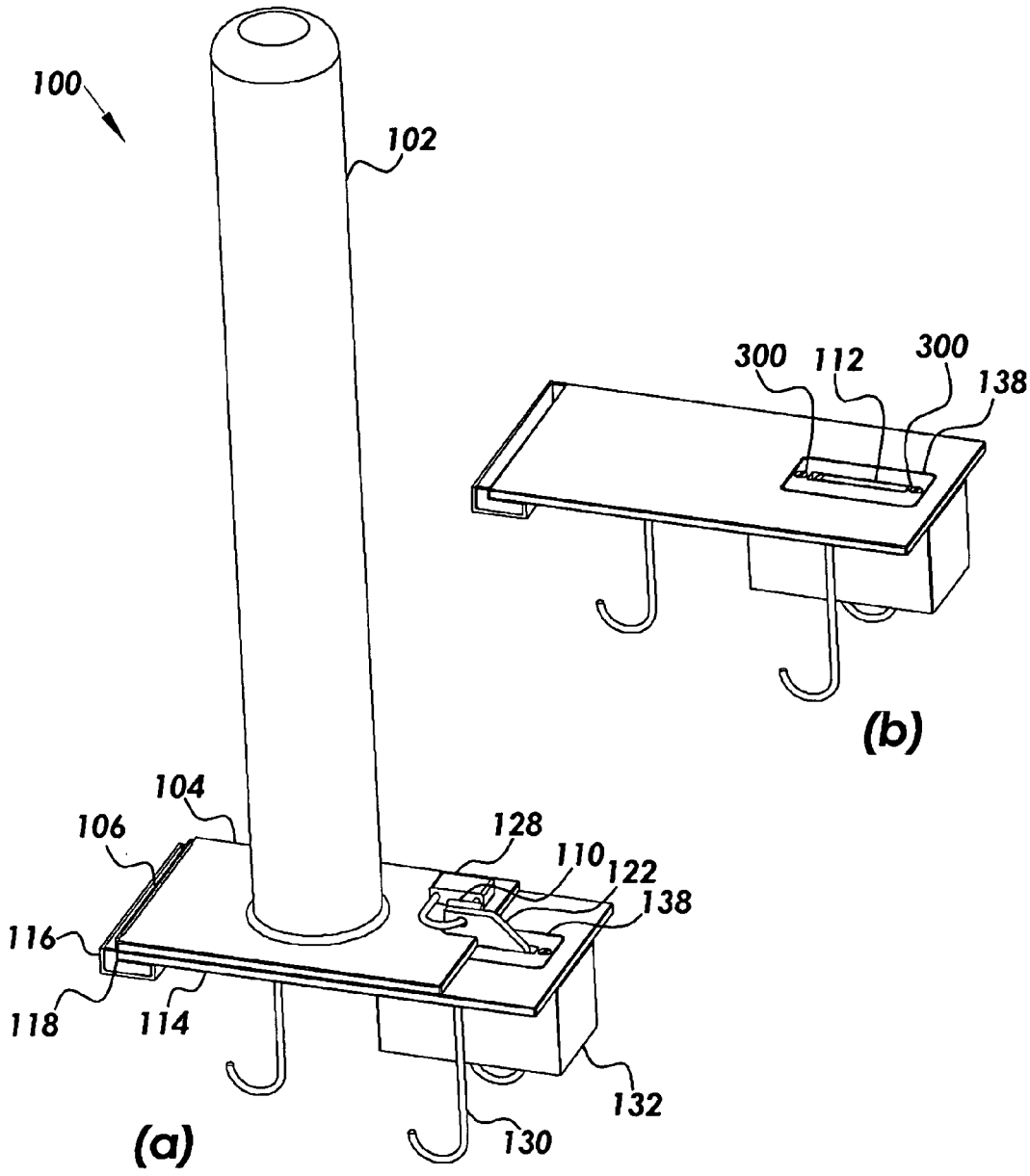
FIGS. 3*a, b* show perspective views of the removable bollard locked to the base plate, and removed from the base plate, respectively according to the present invention.

FIGS. 3*a* and 3*b* depict perspective views of the removable bollard invention 100 with the bollard 102 and bollard plate 104 locked to the base plate 114, and with the bollard 102 and bollard plate 104 removed from the base plate 114, respectively. FIG. 3*a* shows the bollard invention 100 in an assembled configuration with the bollard 102 and bollard plate 104 locked using a lock 128 to the lock juncture 110 and to the retractable latch 122 shown in the first position, or up position, according to the present invention. Further depicted is the catch 106 inserted to the catch receiver 116 and coupled to the base plate first end 118.

Figure 5:
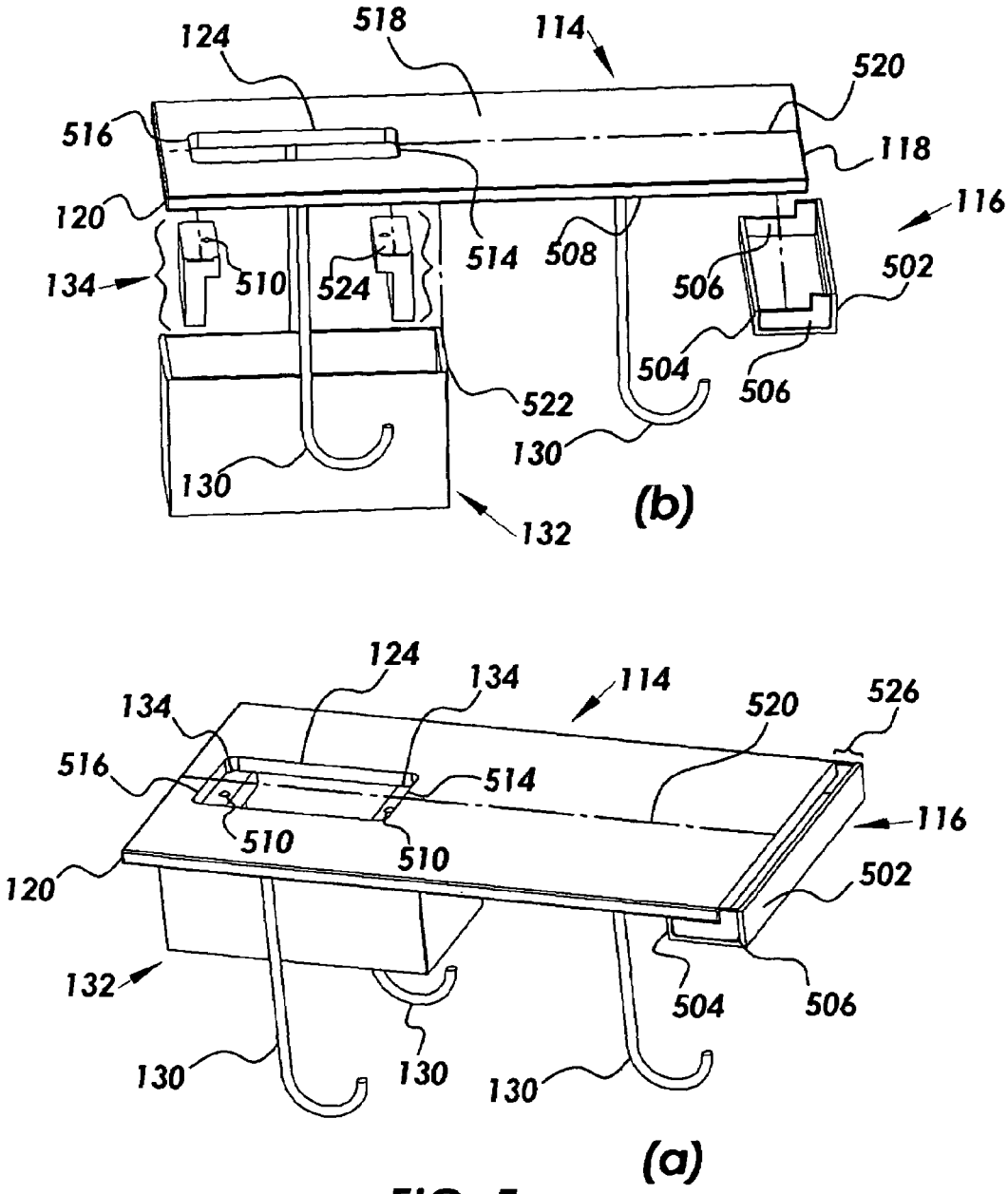
FIG. 5 shows a perspective exploded view of the base plate, retractable latch recess, mounting brackets, catch receiver and latch housing according to the present invention.

FIG. 3*b* depicts the base plate 114 with the retractable latch 112 in the second position, or down position, where the retractable latch 112 lies flush with the latch plate 138 when allowed to move freely by gravity. Further depicted in FIG. 3*b* are mounting screws 300 tightened into mounting holes (see FIG. 5) of the latch plate 138 and are tightened into threaded mounting holes (see FIG. 5).

Figure 4:
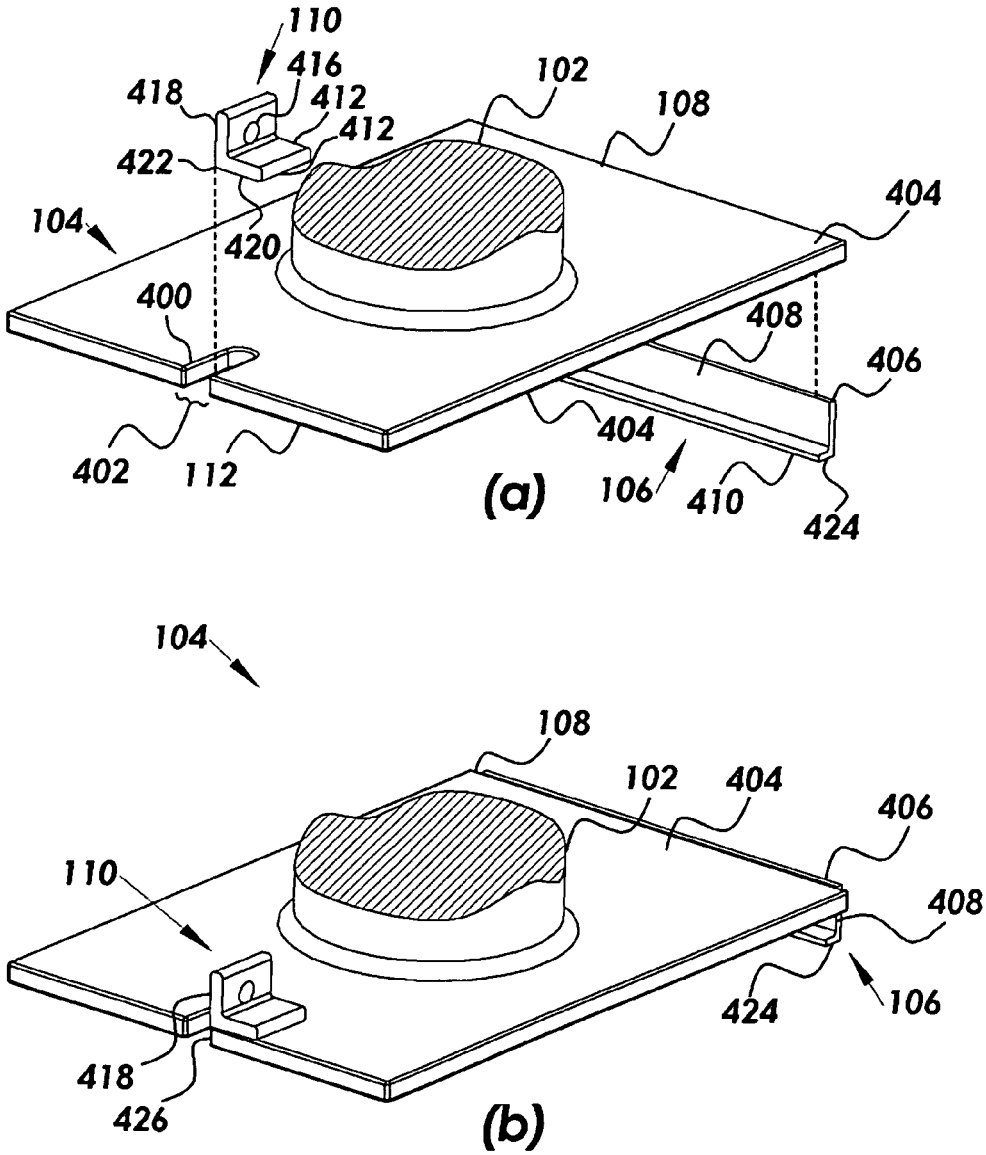
FIGS. 4*a, b* show a partial exploded perspective and an attached perspective view respectively, of the bollard, bollard plate, plate catch and lock juncture according to the present invention.
Figure 7:
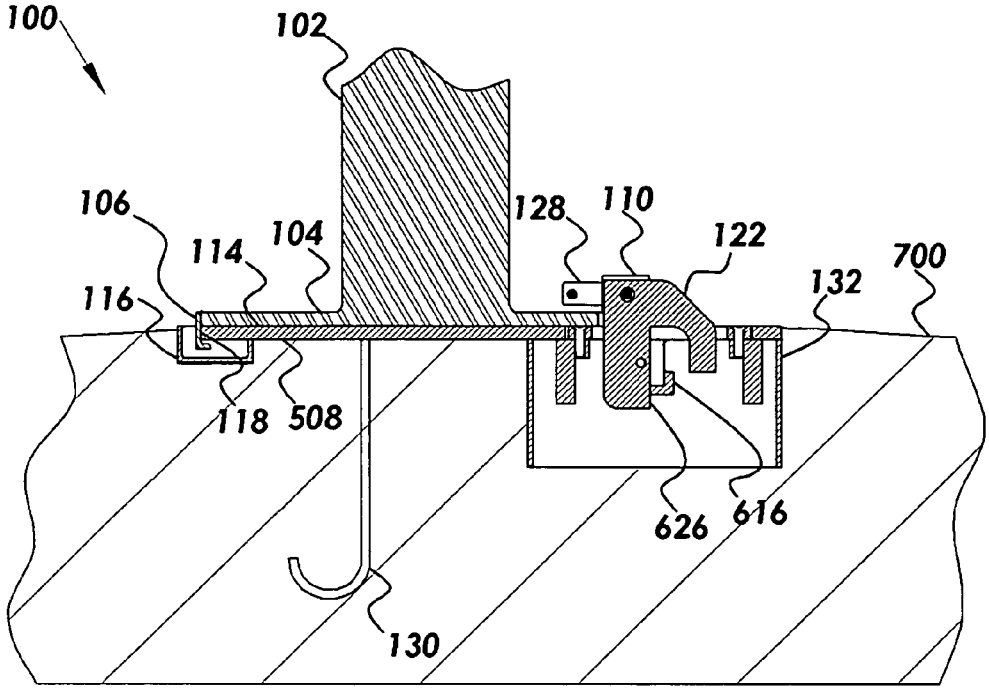
FIGS. 7*a, b* show planar cutaway views of the retractable latch in a first position with the bollard plate locked to the base plated, and the retractable latch in a second position with the bollard plate removed, respectively according to the present invention.
Figure 7:
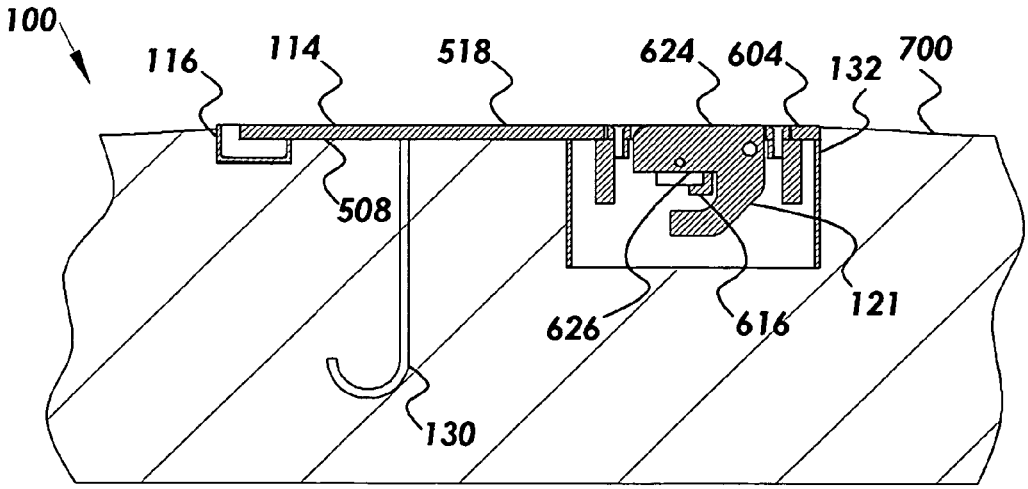

FIG. 4*a* depicts a perspective partial exploded view of the bollard 102 attached to the bollard plate 104, with the plate catch 106 and lock juncture 110 depicted in an exploded perspective view away from the bollard plate 104 according to the present invention. Shown is the bollard plate 104 of generally planar rectangular shape having a bollard plate first end 108 with a latch through-slot 400 of generally rectangular-U-shape with a through-slot open end 402 positioned at the bollard plate second end 112 and at about the center of the bollard plate second end 112. Here, FIG. 4*a* depicts a cutaway bollard 102 attached to the bollard plate top surface 404 and positioned about perpendicular near the center of the bollard plate 104. Further depicted, the catch 106 is of generally extruded L-shape having a catch top end 406, a catch inner L-surface 408 and a catch outer L-surface 410, and a catch bottom end 424, where the catch inner L-surface 408 is attached to the bollard plate first end 108 with the catch top end 406 aligned with the bollard plate top surface 404. As shown, the lock juncture 110 is of generally extruded L-shape having a lock juncture inner L-surface 412 and a lock juncture outer L-surface 414, with a lock juncture through-hole 416 positioned near the center of, and about perpendicular to, the lock juncture vertical wall 418 and a lock juncture planar base 420 is attached to the bollard plate top surface 404 with the edge of a lock juncture corner 422 of the lock juncture outer L-surface 414 positioned near and along the edge of the latch through-slot 400 such that the outer L-surface 414 and an inner wall of the latch through slot 400 are about coplanar and the retractable latch 122 moves freely through the open latch through slot 400 (see FIG. 7).

FIG. 4*b* depicts the bollard 102, bollard plate 104, catch 106 and lock juncture 110 in an attached view, where the elements depicted may be attached using welding, for example. Shown is the catch 106 attached to the bollard plate first end 108 with the catch top end 406 positioned about flush with the bollard plate top surface 404 and the length of the catch top end 406 is parallel along the length or the bollard plate first end 108, where the catch bottom end 424 projects below the bollard plate bottom surface 404 to form a feature for receiving the base plate first end 118 therein (not shown). Further depicted in FIG. 4*b* is the lock juncture 110 attached to the bollard plate top surface 404 with the lock juncture vertical wall 418 about coplanar with a latch through slot proximal inner wall 426.

FIG. 5*a* depicts a perspective partially exploded view of the base plate 114, a catch receiver 116, a pair of mounting brackets 134, a latch housing 132 and at least three J-bolts 130 according to the present invention. The base plate 114 is of generally planar rectangular shape having a base plate top surface 518, a base plate bottom surface 508, a base plate first end 118 and a base plate second end 120, where the base plate second end 120 has a nearby latch port 124 there through. The latch port 124 is of generally rectangular shape and positioned near the base plate second end 118 having a longitudinal axis that is about collinear along a base plate longitudinal axis 520, where depicted are at least three anchor J-bolts 130 attached about perpendicularly to the base plate bottom surface 508 for embedding in a pre-hardened foundation (not shown).

As shown, the catch receiver 116 is of generally extruded U-shape having a catch receiver first wall 502 and a catch receiver second wall 504 and a pair catch receiver end plates 506 of generally planar L-shape attached to the catch receiver extruded ends to form an open top box-like shape. The catch receiver second wall 504 is shorter that the catch receiver first wall 502 by an amount about equal to the thickness of the base plate 114. The catch receiver second wall 504 is attached about perpendicular to the base plate bottom surface 508 and about parallel along the base plate second end 120 with the catch receiver first wall 502 positioned away from and about parallel to the base plate second end 120 to form a catch receiver opening 526 (see FIG. 5*b*) sufficient for receiving the catch 106 (see FIG. 2) therein.

The mounting brackets 134 are of generally extruded L-shape having a threaded mounting hole 510 perpendicularly through the base of the L-shape mounting bracket 134 for receiving mounting screws therein (not shown). The mounting brackets bottom surface 524 is attached to the base plate bottom surface 508, by welding for example, and one mounting bracket 134 is positioned across the latch port first end 514 and a second mounting bracket 134 is positioned across the latch port second end 516 in a mirror image of the opposing mounting bracket 134, where the mounting brackets 134 are perpendicular to the base plate longitudinal axis 520 such that the threaded mounting holes 510 are within the latch port 124 for accepting mounting screws there through (not shown).

The latch housing 132 is of generally rectangular-box shape having a latch housing top end 522 attached to the base plate bottom surface 508 using welding for example, and positioned around the latch port 124 in the base plate 114, where the latch housing 132 shields the retractable latch 122 and the latch bearing 136. The latch housing top end 522 is attached to the base plate bottom surface 508 to house the mounting brackets 134 when placed in pre-hardened foundation (not shown).

FIG. 5*b* depicts a perspective of the base plate 114, a catch receiver 116, a pair of mounting brackets 134, a latch housing 130 and at least three J-bolts 103 assembled using welding (not shown) according to the present invention. As shown, the base plate first end 118 and the catch receiver first wall 502 are combined to create a catch receiver opening 526 for receiving the catch 106 that is attached to the bollard plate first end 108 (not shown). The threaded mounting holes 510 of the mounting brackets 134 are shown within the latch port 124 and are accessible from the base plate top surface 518. As depicted in the exploded perspective view of FIG. 1, the retractable latch 122 is attached to the latch plate 138 using latch bearing 136 (not shown) that is inserted to the latch port 124 to abut the mounting brackets 134, where there are latch plate mounting holes 610 (see FIG. 6*a*) aligned with the threaded mounting holes 510 of the mounting brackets 134 for receiving threaded screws therein.

FIGS. 6*a*-6*d* show perspective views of the retractable latch 122 assembled with the latch plate 138 with mounting screws 300, latch bearing 136, and axle 612, where FIG. 6*a* depicts an exploded view of this assembly. In FIG. 6*a*, the retractable latch 122 is of generally planar J-shape having a lock through-hole 600 located near the base of the J-shape and a pivot through-hole 602 located along the straight leg of the J-shape where an axle 612 is inserted there through. The latch plate 138 is of generally planar rectangular shape having a latch plate top side 604, a bottom side 606 and a latch through-slot 608 of generally rectangular shape that is positioned approximately along a central longitudinal axis (not shown) of the latch plate 138, and has latch plate mounting holes 610 through the latch plate 138 that are positioned near each end of the latch through-slot 608 and along the longitudinal axis.

The latch bearing 136 has a pair of bearing plates 614 and a latch limiting bracket 616, where the bearing plates 614 are of generally rectangular shape having a bearing plate central hole 618 for receiving an axle 612, having axle hardware 620, there through. The bearing plates 614 are attached, at a bearing bracket proximal end, perpendicularly to the latch plate bottom side 606 along each side of the longitudinal length of the latch through-slot 608 and with a bearing plate first end 622 positioned near the latch plate center. The latch limiting bracket 616 is of generally extruded L-shape and attached to the distal ends of the bearing bracket first ends 622 to transversely span the latch through slot 608. The retractable latch 122 is positioned between the bearing plates and an axle 612 is inserted through the bearing plate central holes 618 and the latch pivot through hole 602 and secured using axle hardware 620 to enable the retractable latch 122 to pivot through the latch plate slot 138 to abut the latch limiting bracket 616 and concentrically align the lock through-hole 600 with the lock juncture through hole 416 (see FIG. 4) for receiving a lock 128 (see FIG. 3) there through.

FIGS. 6*b* and 6*c* illustrate perspective views of the retractable latch assembly of FIG. 6*a* with the retractable latch 122 in the first (up) position. The latch bearing 136 includes the bearing plates 614, latch limiting bracket 616 and axle 612 with axle hardware 620, where shown are the bearing plates 614, latch limiting bracket 616, axle 612 with axle hardware 620, and latch plate 138 assembled by welding (not shown) for example. FIG. 6*c* depicts a perspective view with the retractable latch 122 in an first (up) position having a retractable latch front side 626 abutting the latch limiting bracket 616 to desirably position the lock through hole 600 for receiving a lock 128 (not shown) there through.

FIG. 6*d* illustrates a perspective view of the retractable latch 122 in a second (down) position. The latch limiting bracket 616 limits the downward pivot of the retractable latch 122 to position the retractable latch back side 624 about coplanar, or flush with the latch plate top side 604 to eliminate any tripping hazard for pedestrians and the like. The retractable latch 122 automatically falls to the second (down) position aided by gravitational force.

FIGS. 7*a* and 7*b* depict planar cutaway views of the retractable latch in a first (up) position and in the second (down) position, respectively. Shown are the catch receiver 116, the latch housing 132, and base plate 114 with the J-bolts 130 securely embedded in a foundation 700 with the base plate bottom surface 508 recessed therein. FIG. 7*a* depicts the catch 106 inserted to the catch receiver 116 and hooked to the base plate first end 118, while the retractable latch 122 is in the first (up) position with the lock 128 inserted through the lock juncture through hole 416 (not shown) and through the lock through-hole 600 of the retractable latch 122 to securely hold the bollard plate 104 to the base plate 114.

FIG. 7*b* depicts a planar cutaway view of the removable bollard 100 with the retractable latch 122 in the second (down) position with the bollard plate 104 and bollard 102 removed, while the retractable latch 122 falls freely until the retractable latch front side 626 abuts the latch limiting bracket 616, where the retractable latch back side 624 is coplanar with the latch plate top side 604 and with the base plate top surface 518 to provide an obstruction-free access way.

The advantages of the aspects of the present invention are when the bollard 102 and bollard plate 104 are removed from the base plate 114, there is no tripping hazards in the form of obstructions or holes exposed by the base plate 114. The retractable latch 122 is aided by gravity to automatically recess into the latch recess made from the latch housing 132, pair of latch plate mounting brackets 134 and a latch bearing 136, when the bollard and bollard plate are removed.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example the catch 106 may be made from J-hooks attached vertically to the bollard plate first end 108.

All such variations are considered to be within the scope and spirit of the present invention as defined by the following claims and their legal equivalents.

What is claimed is:

1. A removable bollard comprising:

a. a bollard plate having a bollard, a catch at a bollard plate first end and a lock juncture near a bollard plate second end, wherein said catch is of generally L-shape cross-section having a catch inner L-surface and a catch outer L-surface, whereas said catch inner L-surface is attached to said bollard plate first end, where by a catch top end is aligned with a bollard plate top surface; and b. a base plate having a catch receiver at a base plate first end, a retractable latch, a latch plate and a latch recess at a base plate second end, wherein said retractable latch having a first position and a second position, and wherein in said first position said catch is encompassed by said catch receiver and said catch inner L-surface is coupled to said base plate first end and said retractable latch is locked to said lock juncture using a lock to lock said bollard plate to said base plate, and wherein in said second position said retractable latch is recessed into said latch recess within said base plate and lies flush with said latch plate when allowed to move freely by gravity and said bollard plate is removed from said base plate having an obstruction-free access way.

2. The removable bollard of claim 1, wherein said bollard plate is of generally planar rectangular shape comprising a latch through-slot of generally rectangular-U-shape having an open end positioned at about the center of said bollard plate second end.

3. The removable bollard of claim 1, wherein said bollard is attached to a bollard plate top surface and positioned about perpendicular near the center of said bollard plate.

4. The removable bollard of claim 1, wherein said lock juncture is of generally extruded L-shape having a lock juncture inner L-surface and a lock juncture outer L-surface, and wherein a lock juncture through-hole is positioned near the center of a lock juncture vertical wall and a lock juncture planar base is attached to said bollard plate top surface with a lock juncture corner of said lock juncture outer L-surface positioned near said latch through-slot.

5. The removable bollard of claim 1, wherein said base plate is of generally planar rectangular shape comprising a base plate top surface, a base plate bottom surface, a base plate first end, a base plate second end and a rectangular port there through positioned near said base plate second end and centered along a longitudinal axis of said base plate, and wherein at least three anchor J-bolts are attached perpendicularly to said base plate bottom surface for embedding in a pre-hardened foundation.

6. The removable bollard of claim 1, wherein said catch receiver is of generally extruded U-shape having a catch receiver first wall, a catch receiver second wall and a pair catch receiver end plates attached to the extruded ends, wherein said catch receiver second wall is shorter than said catch receiver first wall by an amount about equal to a thickness of said base plate, and wherein said catch receiver second wall is attached perpendicularly to said base plate bottom surface along said base plate first end with said catch receiver first wall positioned away from said base plate first end to form an opening sufficient for receiving said catch therein.

7. The removable bollard of claim 1, wherein said retractable latch is of generally planar J-shape comprising a lock through-hole located near the base of said J-shape and a pivot through-hole located along the straight leg of said J-shape.

8. The removable bollard of claim 1, wherein said latch recess comprises latch plate, a pair of latch plate mounting brackets, a latch bearing and a latch housing.

9. The removable bollard of claim 8, wherein said latch plate is of generally planar rectangular shape comprising a latch plate top side, a latch plate bottom side and a latch plate through-slot positioned approximately along a latch plate central longitudinal axis, and latch plate mounting holes through said latch plate positioned near each end of said latch through-slot and along said latch plate longitudinal axis.

10. The removable bollard of claim 8, wherein said latch plate mounting brackets are of generally extruded L-shape having a threaded mounting bracket hole through a mounting bracket base for receiving mounting screws inserted through said latch plate mounting holes, wherein a first said mounting bracket is attached at said mounting bracket base to said base plate bottom side and across a rectangular port first end and a second said mounting bracket is attached at said mounting bracket base to said base plate bottom side and across a rectangular port second end.

11. The removable bollard of claim 8, wherein said latch bearing comprises a pair of bearing plates and a latch limiting bracket, wherein said bearing plates are of generally rectangular shape having a bearing plate central hole for receiving an axle there through and are attached perpendicularly to said latch plate bottom side along each side of said longitudinal length of said latch plate through-slot and with a bearing plate first end of each said bearing plate positioned near the center of said latch plate, and said latch limiting bracket is of generally extruded L-shape and attached to a bearing plate first end of each said bearing plate to span said latch plate through slot, wherein said retractable latch is positioned between said bearing plates and an axle is inserted through said mounting plates central hole and through said latch through hole and secured to enable said retractable latch to pivot through said latch plate slot and through said latch through-slot in said bollard plate to abut said latch limiting bracket and concentrically align said lock through-hole with said lock juncture through hole for receiving said lock there through.

12. The removable bollard of claim 8, wherein said latch housing is of generally rectangular-box shape having a housing top end attached to said base plate bottom surface and positioned around said rectangular port in said base plate, wherein said latch housing shields said retractable latch and said latch bearing.

13. A removable bollard comprising:

a. a bollard plate having a bollard plate first end, a bollard plate second end and a latch through slot at said bollard plate second end;

b. a bollard attached near the center of said bollard plate;

c. a catch attached to said bollard plate first end with a catch top end aligned with a bollard plate top surface;

d. a lock juncture attached near said bollard plate second end, wherein said lock juncture has a through-hole positioned near a center of a vertical wall, where said vertical wall is positioned near said latch through-slot;

e. a base plate having a base plate first end, a base plate second end, a latch port and at least three anchor J-bolts attached perpendicularly to a base plate bottom surface, wherein said J-bolts are embedded in a pre-hardened foundation;

f. a catch receiver attached to said base plate first end, wherein said catch receiver forms an opening sufficient for receiving said catch therein;

g. a retractable latch having a lock through-hole and a pivot through-hole; and a latch recess connected in said latch port, wherein said latch recess comprises a latch plate, a pair of latch plate mounting brackets, a latch bearing and a latch housing, and wherein said latch bearing comprises a pair of bearing plates, a latch limiting bracket, an axle and axle hardware.

* * * * *